US008261677B2

(12) United States Patent
Herlt

(10) Patent No.: US 8,261,677 B2
(45) Date of Patent: Sep. 11, 2012

(54) GASIFICATION BOILER FOR SOLID FUELS, IN PARTICULAR FOR BALES OF STRAW, WITH OPTIMISED EXHAUST GAS VALUES

(76) Inventor: Christian Herlt, Vielist (DE)

( * ) Notice: Subject to any disclaimer, the term of this patent is extended or adjusted under 35 U.S.C. 154(b) by 536 days.

(21) Appl. No.: 10/595,416

(22) PCT Filed: Oct. 7, 2004

(86) PCT No.: PCT/DE2004/002240

§ 371 (c)(1),
(2), (4) Date: Apr. 17, 2006

(87) PCT Pub. No.: WO2005/040680

PCT Pub. Date: May 6, 2005

(65) Prior Publication Data

US 2009/0107421 A1 Apr. 30, 2009

(30) Foreign Application Priority Data

Oct. 16, 2003 (DE) ..... 103 49 365

(51) Int. Cl.

| | |
|---|---|
| ***F23B 10/02*** | (2011.01) |
| ***F23J 1/00*** | (2006.01) |
| ***F23G 5/16*** | (2006.01) |
| ***F23G 5/027*** | (2006.01) |
| ***F23G 7/02*** | (2006.01) |

(52) U.S. Cl. ..... 110/229; 110/196; 110/216; 110/259

(58) Field of Classification Search ..... 110/229, 110/196, 216, 165 R, 166, 345

See application file for complete search history.

(56) References Cited

U.S. PATENT DOCUMENTS

| | | | | |
|---|---|---|---|---|
| 4,351,249 | A * | 9/1982 | Inovius | 110/210 |
| 4,498,909 | A * | 2/1985 | Milner et al. | 48/209 |
| 4,637,327 | A * | 1/1987 | Jorgensen | 110/289 |

(Continued)

FOREIGN PATENT DOCUMENTS

| | | | |
|---|---|---|---|
| DE | 3408602 | A | 9/1985 |
| DE | 3718022 | C | 11/1988 |
| DE | 19961155 | C | 6/2001 |
| WO | WO 03/060039 | * | 7/2003 |

*Primary Examiner* — Kenneth Rinehart
*Assistant Examiner* — David J Laux
(74) *Attorney, Agent, or Firm* — Brooks Kushman P.C.

(57) ABSTRACT

The invention relates to a gasification boiler for the combustion of solid fuels, in particular bales of straw, for heating purposes and for the production of hot water. The inventive boiler is characterized by optimal combustion and ash separation. The aim of the invention is to carry out the combustion of small particles in the most complete manner possible and to achieve an almost total separation of the ashes from the combustion gas upstream of the heat exchangers. To achieve this, according to the first feature of claim 1, the combustion and gasification chamber comprises lateral depressions that are configured next to the central grating and combustion chamber. Coarse particles collect in said depressions, leaving the fine particles to be carried with the combustion gas into the combustion chamber. According to the second feature of said claim, a cylindrical combustion chamber, configured as an additional component, is connected to the outlet of the combustion chamber. Said secondary combustion chamber significantly increases the combustion time, allowing small particles and partially oxidized gases to burn completely. According to the third feature, a cylindrical ash separator, configured as an additional component, is connected to the combustion chamber.

14 Claims, 3 Drawing Sheets

U.S. PATENT DOCUMENTS 5,630,367 A * 5/1997 Kobata et al. ..... 110/229
5,720,165 A * 2/1998 Rizzie et al. ..... 60/39.464
5,901,653 A * 5/1999 Jennebach et al. ..... 110/213
6,758,149 B2 * 7/2004 Oiwa et al. ..... 110/211
7,228,806 B2 * 6/2007 Dueck et al. ..... 110/266
2005/0051918 A1 * 3/2005 Muramatsu et al. ..... 264/29.7

* cited by examiner

GASIFICATION BOILER FOR SOLID FUELS, IN PARTICULAR FOR BALES OF STRAW, WITH OPTIMISED EXHAUST GAS VALUES

DESCRIPTION

The invention relates to a gasification boiler for the combustion of solid fuels, especially bales of straw, for heating purposes and for the production of hot water. The invention is distinguished by optimum combustion and ash separation. The prescribed exhaust gas values are therefore reliably kept to.

PRIOR ART

The principle of fuel gasification in a furnace space and of aftercombustion in a separate combustion space has substantial advantages for fuels in lump form. These are primarily a substantial, clean combustion, and therefore low environmental pollution and a high energy yield. The known designs comprise a closed fuel-filling space with filling door, a lower burn-up and gasification zone, a lower grating and combustion nozzle with a combustion space, air feeds, heat exchanger and ash separator situated under or behind it. A heating boiler of this type for combustion of solid material is described, for example, in DE-A 34 08 602 and DE-C 37 18 022. To improve the combustion, special air and combustion gas guides have been proposed. According to DE-A 3411822, the filling shaft is in the form of a double cone with gas outlet openings and an annular combustion duct in the extension. A uniform burn-up and simple construction are intended to be realized therewith. DE-C 3617146 illustrates a special air feed for the primary air in order to achieve a good combustion gas/air mixture. The fan is mounted on the filling door and feeds external air into three levels of the fuel shaft. The solution in DE-C 3718022 contains two air feed levels in the fuel shaft and one to the combustion space. With the recycling of exhaust gas, particularly good gasification is intended to be achieved.

The fuel comprising bales of straw causes particular requirements. There is the problem of uniform gasification which is obstructed by carbonization of the outer layers. A high content of uncombusted small constituents and a low ash melting point have an unfavorable effect on the exhaust gas values and dirty the heat exchange surfaces (DE-A 41 34 754).

OBJECT OF THE INVENTION

It is the object of the invention to carry out the combustion even of small particles as completely as possible and to virtually completely separate the ash from the combustion gas upstream of the heat exchangers.

This object is achieved by the features of claim 1.

According to feature 1, the fuel and gasification space has depressions laterally next to the centrally arranged grating and the combustion space. Coarse particles accumulate in said depressions while just the fine particles are still carried along by the combustion gas into the combustion space. The coarse particles can outgas in the depressions and do not load the combustion gas flow. After the combustion has ended, the remaining ash can be removed there.

According to feature 2, a cylindrical combustion chamber designed as an additional constructional unit is connected to the outlet of the combustion space. This aftercombustion chamber considerably extends the combustion time, as a result of which small particles contained and partially oxidized gases completely combust. The tangential introduction of the combustion gas acts as a cyclone, so that further ash accumulates at the bottom. This can be removed through a cover.

According to feature 3, a cylindrical ash separator which is designed as an additional constructional unit is connected to the combustion chamber. In this ash separator, the remaining ash constituents are removed from the flue gas. The heat exchanger arranged downstream is therefore no longer loaded with ash.

The interaction of the three structural features therefore brings about a more complete combustion, improved ash separation and therefore lower loading of the exhaust gas. In addition, however, the maintenance and service life of the heat exchanger are also improved.

Special refinements of the invention are explained in the subclaims.

DETAILED DESCRIPTION OF THE PREFERRED EMBODIMENTS

Figure 2:
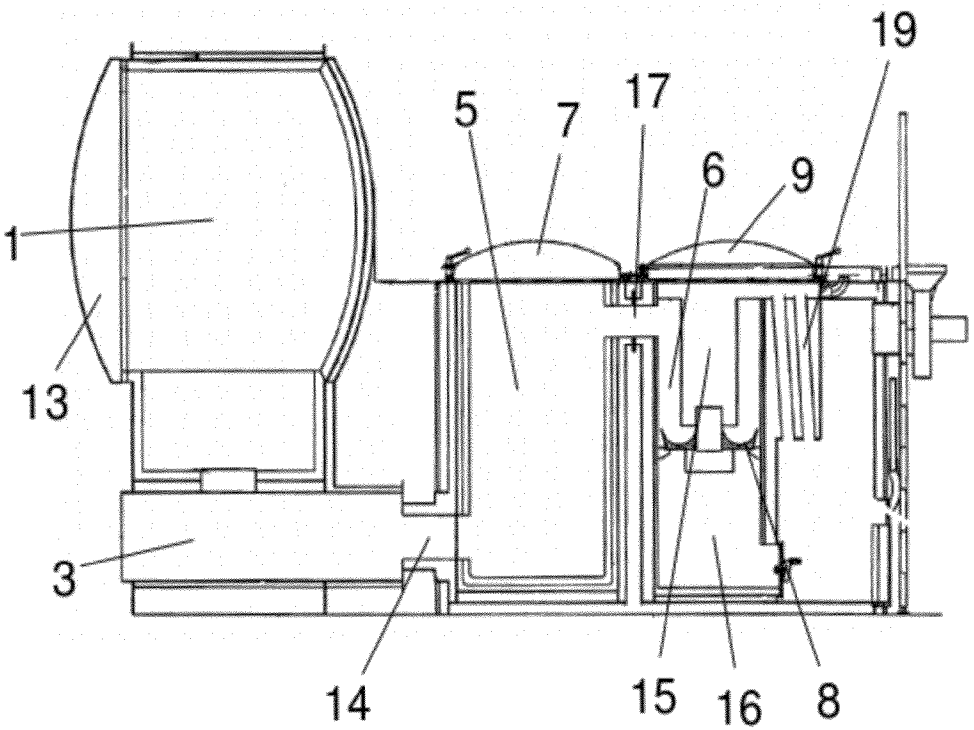
FIG. 2 shows the side view of the entire heating installation in section.
Figure 1:
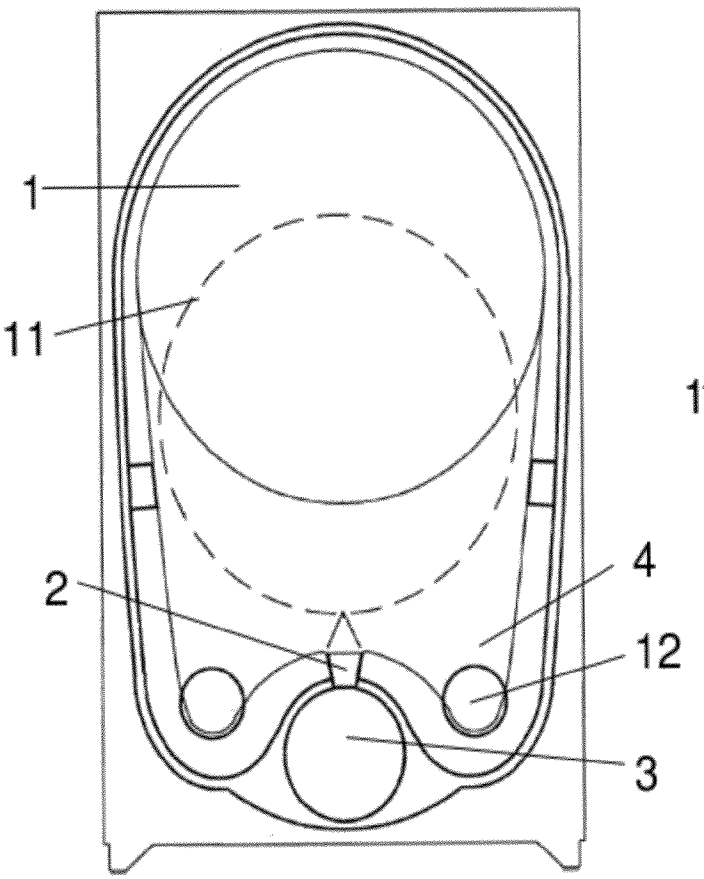
FIG. 1 shows a gasification boiler in front view in section.
Figure 3:
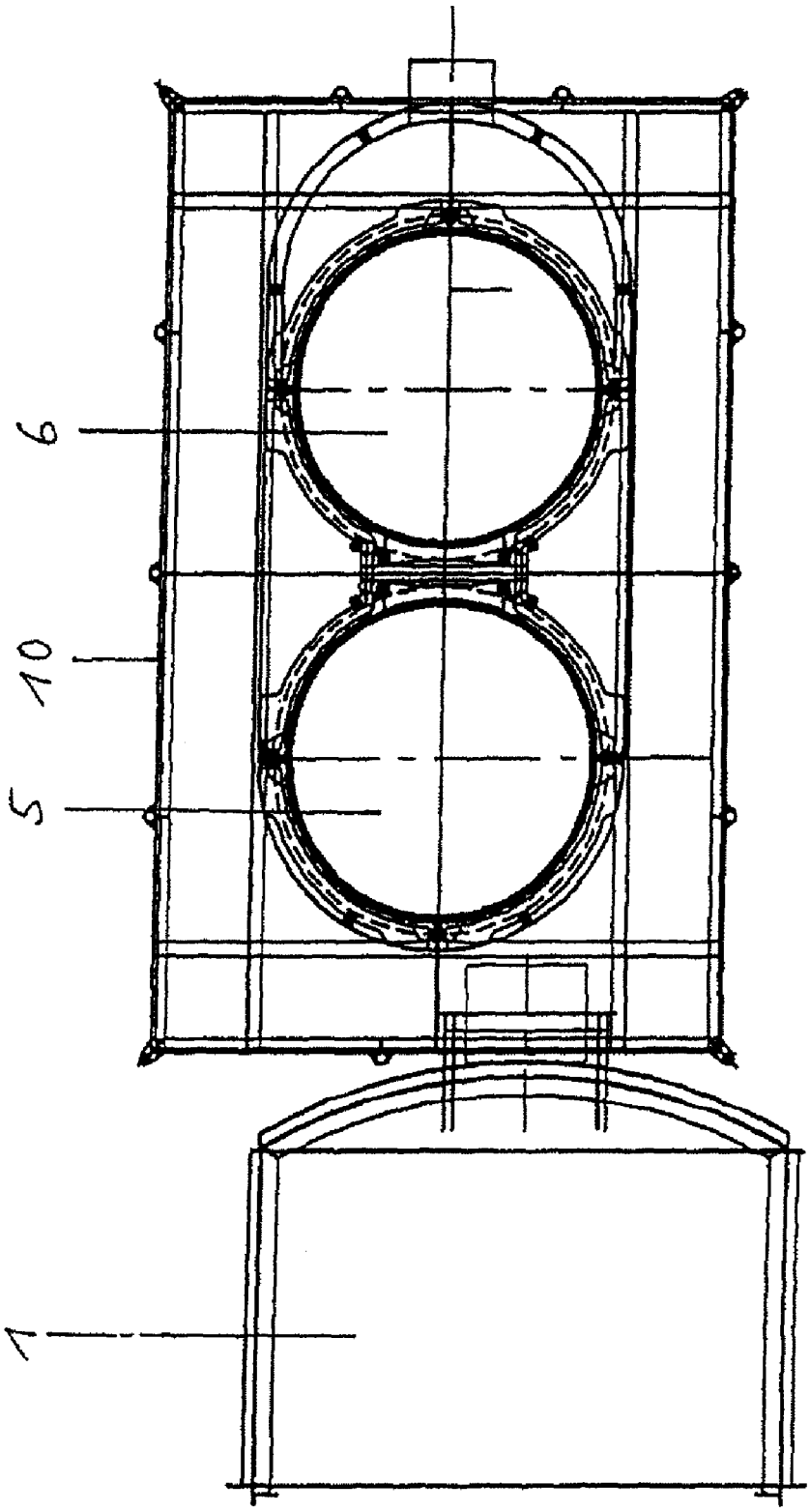
FIG. 3 shows a plan view of the entire heating installation.
Figure 4:
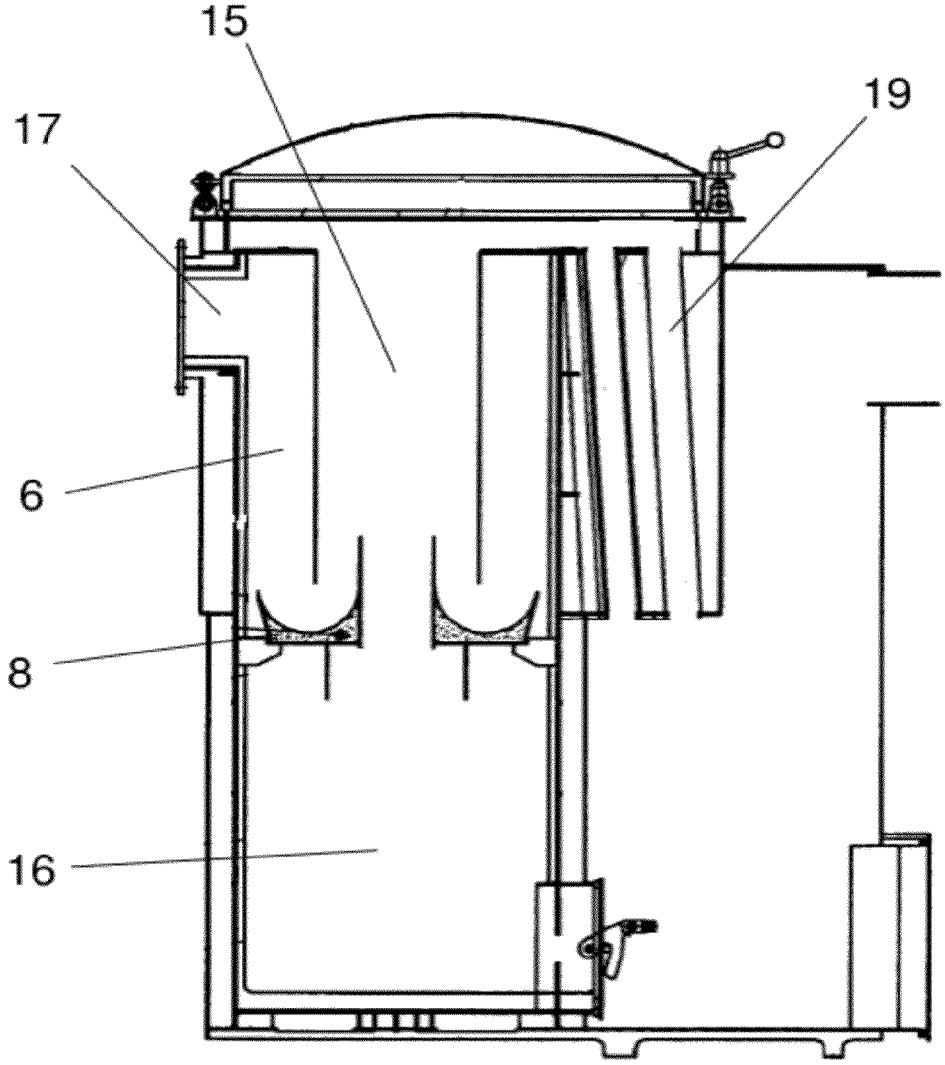
FIG. 4 shows the ash separator of an embodiment of the present invention in side view in section.

A fuel and gasification space 1 and, below it, a horizontal, cylindrical combustion space 3 are arranged in a housing. A filling door 13 for the bales of straw 11 and two doors 12 for the removal of ash are fixed on the front side. At the lower apex of the fuel and gasification space 1, there is a longitudinal slot in the bottom extending over the entire depth. A grating 2 is embedded in said longitudinal slot. Situated below the grating 2 are gas nozzles which lead into a combustion space 3. The latter comprises pipe sections of refractory concrete which are guided in a steel pipe.

The fuel and gasification space 1 has depressions 4 parallel to the grating 2 and combustion space 3. Said depressions are of half-shell-shaped design. The wall has a respective door in the end region for the removal of ash.

The heating boiler with fuel and gasification space 1 and combustion space 3 is designed as a constructional unit.

The combustion chamber 5, ash separator 6 and heat exchanger which are arranged downstream are brought together by means of a framework 10 to form a further constructional unit. Combustion chamber 5 is connected at the bottom tangentially to the outlet 14 of the combustion space 3, so that the combustion as rises therein in a swirling manner. Ash separator 6 is connected at the top tangentially to the outlet 17 of the combustion chamber 5. Combustion chamber 5 and ash separator 6 have a cylindrical housing standing perpendicularly. The walls of the housings are insulated and the latter are closed at the top by a shell-shaped cover.

In the ash separator, a pipe 15 is fitted centrally in the upper region and below it a circular baffle plate 8 is fitted in such a manner that a narrow annular opening for the depositing of ash remains from the outer wall.

The adjoining heat exchangers are arranged in a vertical flue gas vent 19. A circulating air fan causes the combustion gases to have a rotational movement in the fuel and gasification space 1. The loose, heavy particles ofthe combustion matter accumulate in the outer, lateral depressions 4 where they completely combust. Lightweight airborne particles are carried along by the combustion gas flow and at the latest are completely combusted in the combustion chamber 5. Repeated separation of the ash takes place in the ash separator 6. When gas is admitted, the ash particles are pressed against the inner wall and, when deflected by the baffle plate 8, drop downward. The removal of ash takes place through the upper covers 7, 9 and a door in the bottom region 16 of the ash separator 6. The gas flow cleaned in this manner is conducted across the heat exchangers.

LIST OF REFERENCE NUMBERS

1 Fuel and gasification space
2 Grating
3 Combustion space
4 Lateral depression
5 Combustion chamber
6 Ash separator
7 Cover combustion chamber
8 Baffle plate
9 Cover ash separator
10 Framework

The invention claimed is:

1. A gasification boiler for burning entire bales of straw at one time, the boiler comprising:

a fuel and gasification chamber configured to receive an entire bale of straw at one time, the chamber closable by a filling door and having air feeds and depressions for collecting and holding ash resulting from the combustion of the bale of straw, the depressions disposed adjacent to a grating arranged at the bottom of the fuel and gasification chamber and configured to allow coarse straw ash particles to completely combust and not enter a flow of a combustion gas;

a combustion chamber situated below the grating and configured to receive and combust the combustion gas;

a secondary combustion chamber connected to an outlet of the combustion chamber configured to further receive and combust the combustion gas; and a cylindrical ash separator for collecting fine straw ash particles located downstream from the secondary combustion chamber and having an inlet connected at the top tangentially to an outlet of the secondary combustion chamber, the ash separator having an outlet connected to a heat exchanger.

2. The gasification boiler as claimed in claim 1, characterized in that the depressions of the fuel and gasification chamber are of half-shell-shaped design and run parallel to the combustion chamber and each depression has a small door for the removal of coarse straw ash.

3. The gasification boiler as claimed in claim 1 characterized in that the secondary combustion chamber is cylindrical and connected at the bottom tangentially to the outlet of the combustion chamber, so that the combustion gas rises therein in a swirling manner causing fine straw ash particles to accumulate at a bottom of the secondary combustion chamber which is closed at the top by a cover.

4. The gasification boiler as claimed in claim 1 characterized in that a substantially vertical pipe is arranged centrally within the ash separator, the pipe having a lower opening approximately halfway up a height of the ash separator.

5. The gasification boiler as claimed in claim 4, characterized in that a circular baffle plate is fitted below the opening of the pipe in such a manner that a narrow annular opening for the depositing of the fine ash particles between an outer wall of the ash separator and the baffle plate, and in that the ash separator can be closed at the top by a cover.

6. The gasification boiler as claimed in claim 1 characterized in that the secondary combustion chamber, the ash separator and the heat exchanger are connected in a framework to form a unitary structure.

7. The gasification boiler as claimed in claim 2 characterized in that the secondary combustion chamber is cylindrical and connected at the bottom tangentially to the outlet of the combustion chamber so that the combustion gas rises therein in a swirling manner and in that the combustion chamber can be closed at the top by a cover.

8. The gasification boiler as claimed in claim 2 characterized in that a substantially vertical pipe is arranged centrally within the ash separator, the pipe having a lower opening approximately halfway up a height of the ash separator.

9. The gasification boiler as claimed in claim 3 characterized in that a substantially vertical pipe is arranged centrally within the ash separator, the pipe having a lower opening approximately halfway up a height of the ash separator.

10. The gasification boiler as claimed in claim 2 characterized in that the secondary combustion chamber, the ash separator and the heat exchanger are connected in a framework to form a unitary structure.

11. The gasification boiler as claimed in claim 3 characterized in that the secondary combustion chamber, the ash separator and the heat exchanger are connected in a framework to form a unitary structure.

12. The gasification boiler as claimed in claim 4 characterized in that the secondary combustion chamber, the ash separator and the heat exchanger are connected in a framework to form a unitary structure.

13. The gasification boiler as claimed in claim 5 characterized in that the secondary combustion chamber, the cylindrical ash separator and the heat exchanger are connected in a framework to form a unitary structure.

14. A gasification boiler for burning entire bales of straw at one time, the boiler comprising:

a fuel and gasification chamber configured to receive an entire bale of straw at one time, the chamber closable by a filling door and having air feeds and depressions for collecting and holding ash resulting from the combustion of the bale of straw, the depressions disposed adjacent and parallel to a longitudinal grating arranged at the bottom of the fuel and gasification chamber and configured to allow coarse straw ash particles to completely combust and not enter a flow of a combustion gas;

a combustion chamber situated below the grating and configured to receive and combust the combustion gas;

a cylindrical secondary combustion chamber configured to further receive and combust the combustion gas connected at the bottom tangentially to an outlet of the combustion chamber so that the combustion gas rises therein in a swirling manner causing fine straw ash particles to accumulate at a bottom of the secondary combustion chamber;

a cylindrical ash separator for collecting fine straw ash particles located downstream from the secondary combustion chamber and having an inlet connected at the top tangentially to an outlet of the secondary combustion chamber to force the fine ash particles against an outer wall of the ash separator, the ash separator having a substantially vertical pipe arranged centrally therein, the pipe having a lower opening approximately halfway up a height of the ash separator;

a circular baffle plate fitted below the opening of the pipe in the ash separator such that a narrow annular opening exists between the outer wall of the ash separator and the baffle plate to allow for the deposition of the fine ash particles at the bottom of the ash separator after it is pressed against the outer wall of the ash separator; and a heat exchanger connected to an outlet of the ash separator.

* * * * *